364-422

4/26/88 OR 4,740,897

United States Patent [19]

Delatorre et al.

[11] Patent Number: 4,740,897

[45] Date of Patent: Apr. 26, 1988

[54] MEMORY OPERATED WELL TOOLS

[75] Inventors: Leroy C. Delatorre, Sugar Land; Homer M. Wilson, Houston, both of Tex.; E. René Pingenot, Springfield, Mo.

[73] Assignee: Panex Corporation, Sugar Land, Tex.

[21] Appl. No.: 718,112

[22] Filed: Mar. 29, 1985

[51] Int. Cl.[4] ..... G06F 15/20

[52] U.S. Cl. ..... 364/422; 73/154

[58] Field of Search ..... 364/422, 571, 573, 138; 73/151, 152, 153, 154; 367/25, 33, 68, 27, 69; 343/33 WL, 853, 861; 371/14, 66

[56] References Cited

U.S. PATENT DOCUMENTS

| | | | |
|---|---|---|---|
| 4,033,186 | 7/1977 | Bresie | 73/154 |
| 4,161,782 | 7/1979 | McCracken | 73/154 |
| 4,355,365 | 10/1982 | McCracken | 364/422 |
| 4,412,284 | 10/1983 | Kerfore et al. | 371/66 |
| 4,433,395 | 2/1984 | Iyehara et al. | 371/66 |
| 4,452,075 | 6/1984 | Bockhorst et al. | 73/151 |
| 4,553,223 | 11/1985 | Bouhelier et al. | 364/900 |
| 4,593,370 | 6/1986 | Balkanli | 364/422 |
| 4,611,289 | 9/1986 | Coppola | 371/66 |
| 4,646,307 | 2/1987 | Nishimura | 371/66 |

*Primary Examiner*—Jerry Smith
*Assistant Examiner*—Kimthanh Tbui

[57] ABSTRACT

A self-contained, down hole powered electrical system in which the tool has nonvolatile memory means which are independent of applied power thereby permitting the power to the system to be turned off between sampling and further including a system for reentering data to nonvolatile memories for retention during high temperature operations.

8 Claims, 4 Drawing Sheets

MEMORY OPERATED WELL TOOLS

FIELD OF THE INVENTION

This invention relates to oil field tools, and more particularly to testing and operation of self-contained downhole tools for measuring parameters such as pressure or temperature over a prolonged period of time.

BACKGROUND OF THE INVENTION

Self-contained downhole tools on a wire line for measuring pressure and temperature in a borehole have been in use for some time in oil field applications. Pressure and temperature measurements in a production well over a long period of time provide significant data for analysis of the productivity of the well.

Where the downhole tool uses a contained D.C. battery pack for electrical power to the downhole measuring and recording equipment, the battery pack is a limiting factor to the period of time that downhole measurements can be made because the equipment expends the electrical power continuously. Where the electrical power is utilized intermittently by a downhole switching system, other problems occur. For example, some tools utilize memory systems for recording data which automatically erase if the power is shut off thus losing prior data. In either case, it is desirable to know prior to running the tool in the well bore that the tool is functionally ready to operate, and in a downhole operation, that the data is stored independently of electrical power to the system.

PRIOR ART

Relevant prior art is:

U.S. Pat. No. 4,033,186 issued 7/05/77 to Bresie

U.S. Pat. No. 4,161,782 issued 7/17/79 to McCracken

THE PRESENT INVENTION

The present invention incorporates in a self-contained downhole instrument for use in oil field production logging operations, a system for checking the integrity of the operation of the equipment prior to going in the well bore and a system for retaining data downhole independent of applied power.

The instrument includes sensors for measuring parameters in a well bore and providing an electrical signal as a function of the sensed parameter to an electrical processing means. The electrical processing means includes a random access memory (RAM), a central processing unit (CPU), a nonvolatile program memory and a nonvolatile data memory and a clock, all which are interconnected for an interactive interrelationship by a data bus. The clock is operated by a power supply which is powered by a battery source of energy. The processing means is also coupled via an input/output circuit to a driver circuit and an audible sound means.

The system is self-contained and when the battery pack is coupled to the instrument housing at the earth's surface, the power supply actuates the clock which operates the control to switch on power to the processing means and initiate operation of the CPU. The CPU is operated by a pre-installed software program to check out the functioning of the entire instrument and at the conclusion of the testing program, the driver actuates an audible sound means so that the operator can be assured by an audible sound emission from the tool that it is functioning correctly prior to placing the instrument in the borehole.

The instrument is then positioned in the borehole for operation. The clock controls the functions under software control to periodically initiate operation of the processing equipment for a time period determined by the number of data samples to be obtained and the sampling rate for the data sensing and to turn off the processing equipment to remove power at the completion of an instruction. Thus, the downhole battery pack is utilizable over a long period of time because it only supplies power to the processing equipment when instructed to do so by program instructions to the clock. Each time the processing equipment is turned "on", the pre-installed software recording program runs through a program cycle of operations to find the last measured parameter and then records the new parameter for the time period of the next measurement. The measured parameters are processed by the RAM and stored in the nonvolatile data memory and each data measurement is applied at least twice to the nonvolatile memory. When a time period of measurement is concluded and the processing equipment turned "off", the RAM memory is lost but the data is stored or retained in the nonvolatile memory for subsequent read out when the tool is returned to the earth's surface.

FIGS. *2a, 2b, 2c* are interrelated representation of a computer program; and

Figure 3:
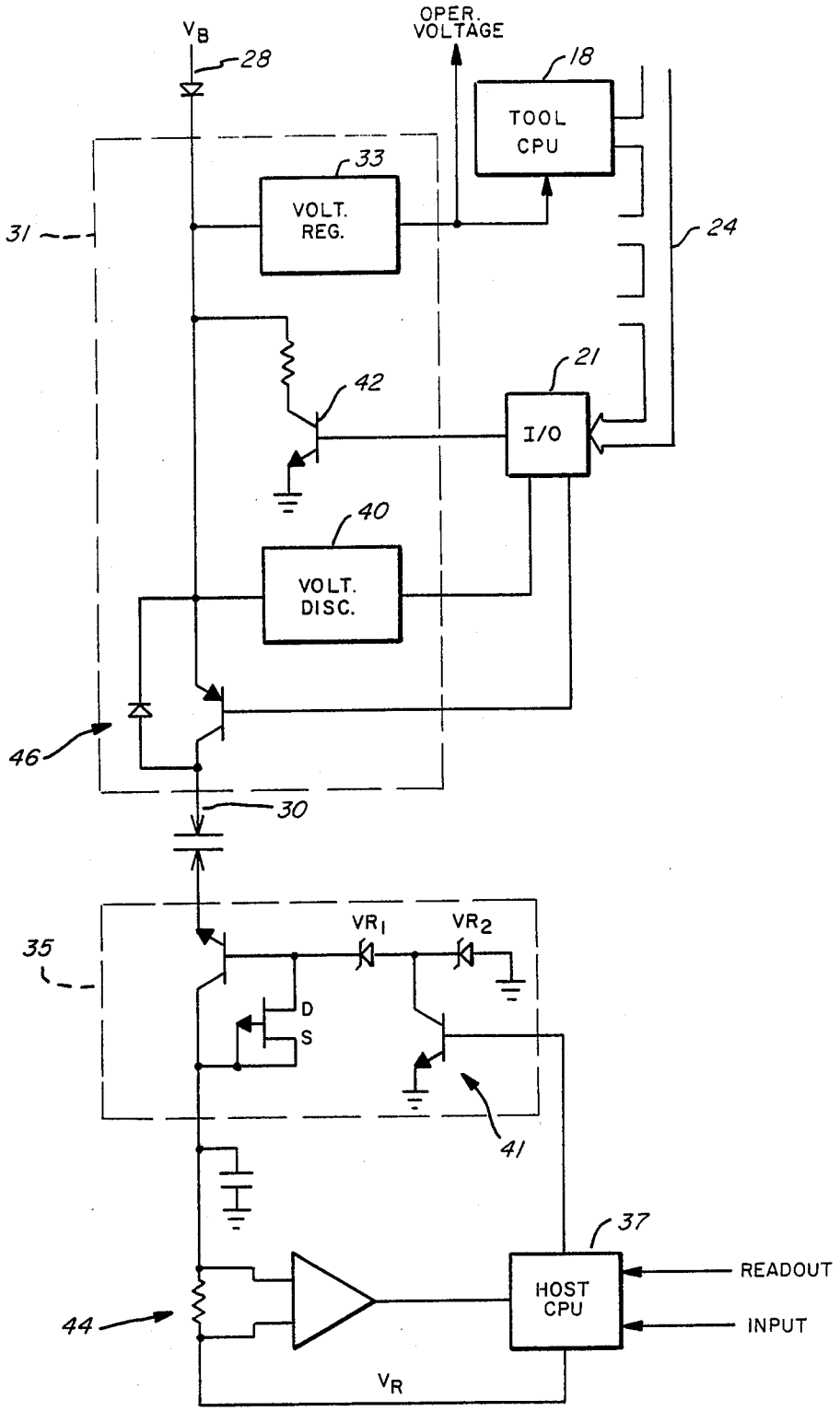

FIG. 3 is an electronic schematic of a system for inputting and collecting data from the memory and the processing equipment.

DESCRIPTION OF THE INVENTION

Figure 1:
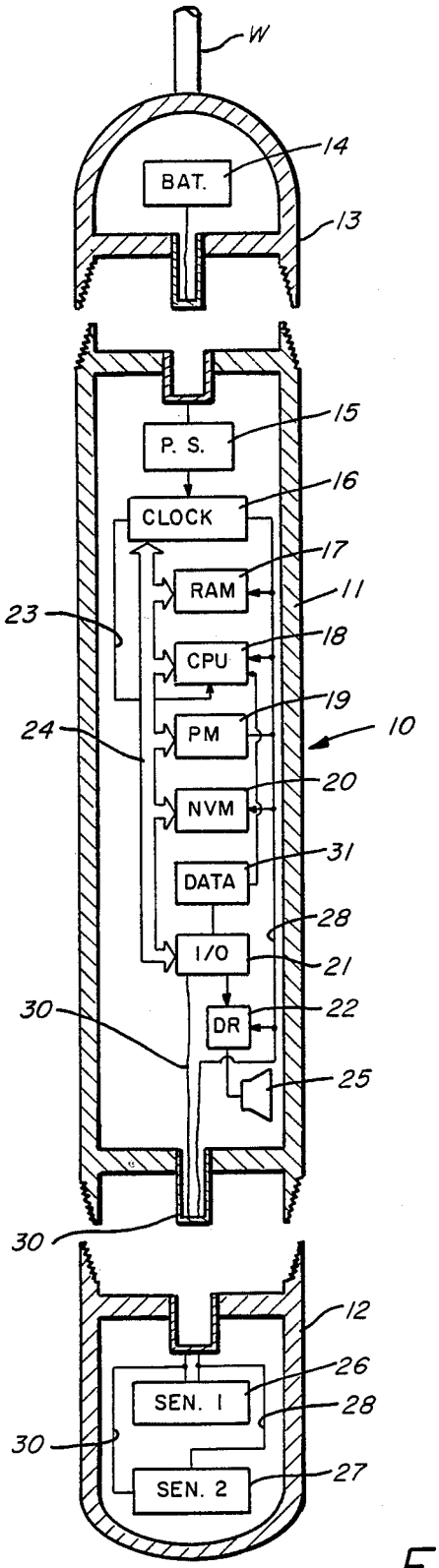
FIG. 1 is a schematic illustration of a well tool embodying the present invention.

Referring now to FIG. 1 a downhole tool 10 suitable for use in a production well for measuring temperature and pressure over a period of time is illustrated. The tool 10 includes three separate pressure and fluid tight housings 11, 12 and 13, which are typically sized for passage through a small diameter production tubing by means of a wireline W and the connecting head 13 which contains the D.C. batteries 14. The head 13 and housing 11 are independently sealed and when interconnected, the battery means 14 are electrically coupled to the electrical processing circuits within the housing 11. By separately housing the battery pack and the electrical processing circuits in the housing 11, the processing circuits are never exposed to the field environments. For example, after a test, it is only necessary to exchange batteries to run the next test. The pressure and temperature sensors are contained in a lower housing 12. Thus, when it is desired to run the sensors on an electrical wireline, they can be used independently of the housings 11 and 13.

The present invention enables testing of the equipment at the surface with new batteries to determine if the tool is functioning properly and if all of the programs and memory are proper for the next test as will be explained later.

In the housing 11 is an electronic power supply 15 which supplies electrical power to an electronic clock or timer means 16. The clock means 16 is an electronic device which functions over a period of time to periodically control the application of power to the processing equipment (shown by the line 28) and to discontinue the power to the processing equipment in accordance with a pre-selected set of pre-installed software recording instructions. Each recording instruction enables the measuring and memory circuits in the tool to operate for a time period as determined by the number of samples to be obtained and to be turned off for discrete time intervals as determined by the sample rate until the completion of the test. The time periods and time intervals can be independently set for a range or number of the program instructions. In the present invention, 32 program instructions are used, each program recording instruction establishing a time sequence for sampling a predetermined number of pressure and temperature data samples and the time interval or sampling rate between taking the next number of samples.

The clock means 16, when turned on, enables operating power to be applied to a random access memory (RAM) circuit means 17, a central processing unit (CPU) circuit means 18, a nonvolatile program memory (PM) circuit means 19, a nonvolatile data memory (EPROM) circuit means 20, an input-output (I/O) circuit means 21, and a driver circuit means 22. At the same time, the clock means 16, by a connection 23, resets the CPU 18 each time it is turned on. The clock 16, RAM 17, CPU 18, program memory 19, the I/O 21 are all interconnected by a data bus 24 which interrelates the programed functions and data transfer for the various units. An audible accoustic device 25 is connected to the driver circuit 22. A first sensor 26 and a second sensor 27 are coupled to the I/O circuit 21 by a connector 30 and the data from the sensors is in a digital format or converted to a digital format.

Figure 2A:
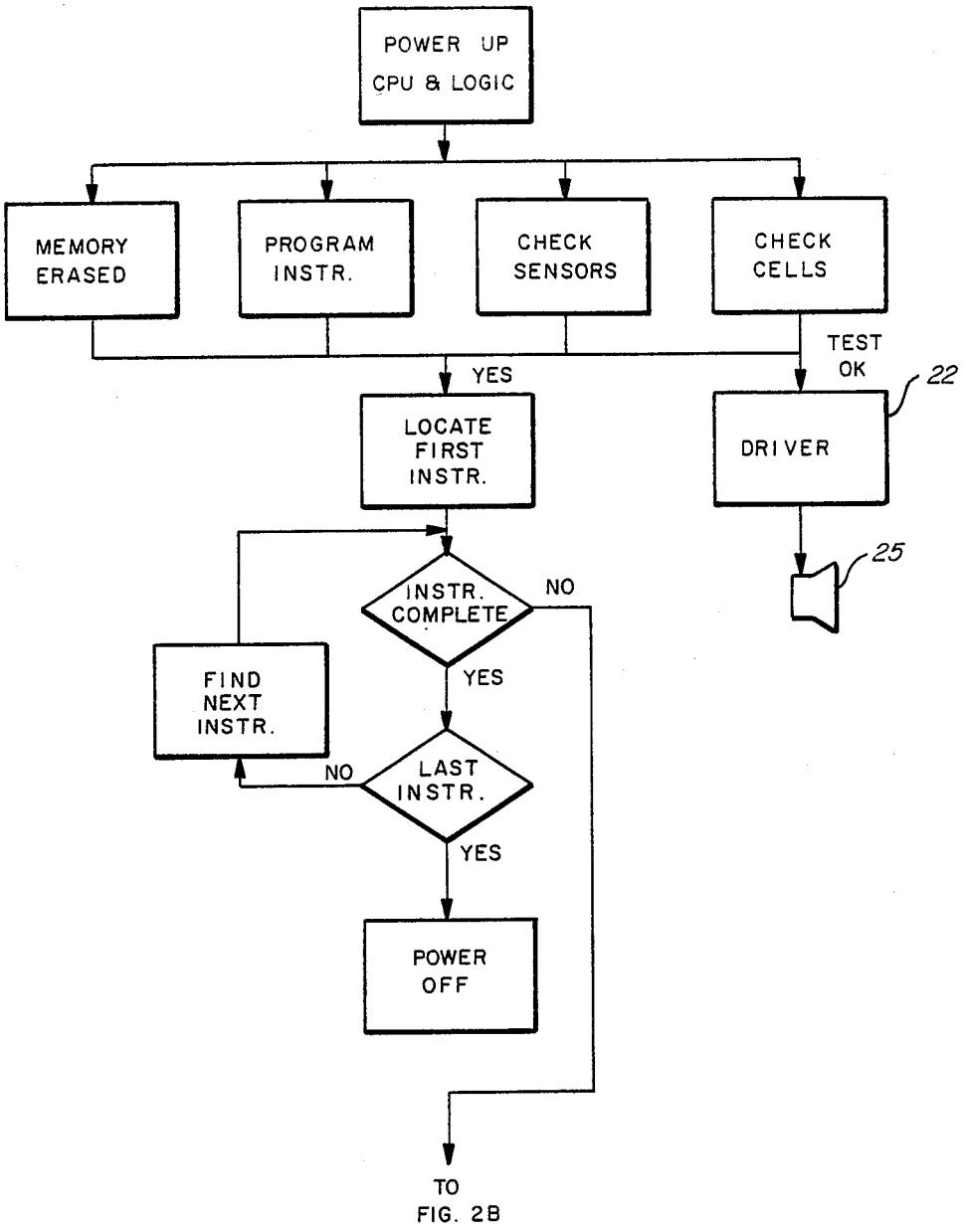
Figure 2B:
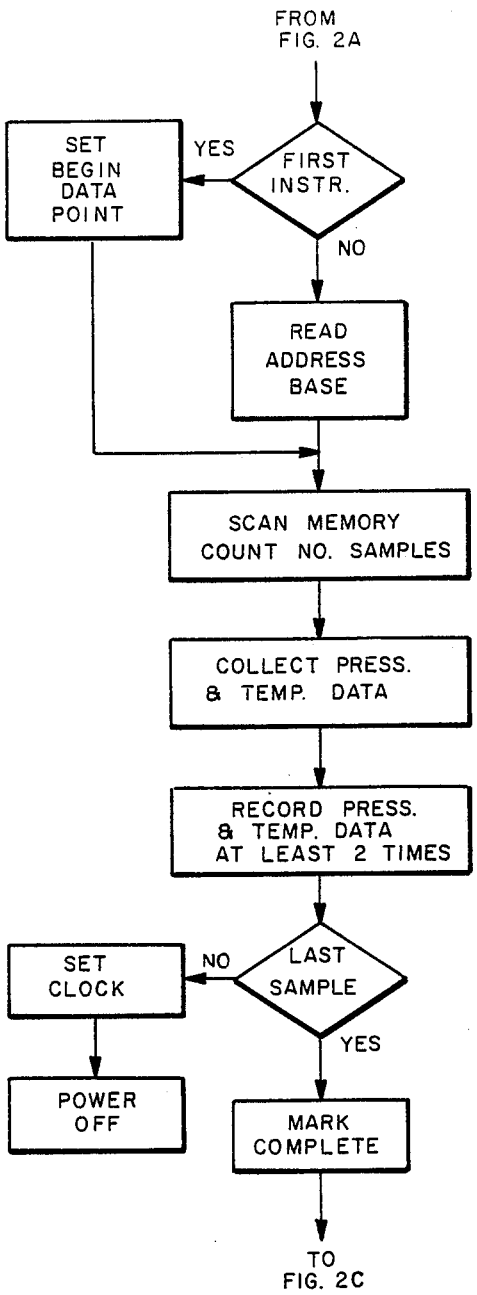
Figure 2C:
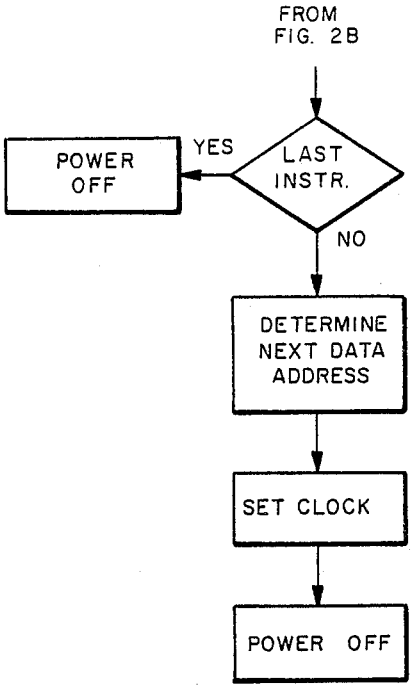

In operation of the system, the clock means 16 controls the period of time that the various units are turned off. The clock means 16 is operated by the recording program instructions which are input at the earth's surface prior to running the tool. The recording program instructions are a series of commands to operate software to control the operation of the equipment for a discrete number of sampling periods and set the time intervals between each sampling period. In each sampling period of an instruction, data samples for each of the temperature and pressure data are obtained and the number of samples of each data sample is established by the instruction. The recording program instructions thus serve to direct the operating functions of the CPU to obtain data samples. The flow chart for the recording program instructions is shown in FIGS. 2A–2C.

At the earth's surface, when the power is applied to the CPU and logic circuits, a program instruction to the CPU ascertains if all of the following conditions are met by the tool (See FIG. 2):

(1) that the nonvolatile memory is erased and contains no data;
(2) that the program instructions are in the CPU;
(3) that all of the memory in the system properly functions; and
(4) if the sensors are properly functioning.

If all of these functions are met or satisfied by the system, the driver circuit 22 is actuated for a one minute period to actuate the audible acoustic device 25 such as a beeper. This assures the operator, prior to running the tool in the well bore, that the batteries are operating, the processing equipment is functioning, that the memory is clear of prior data, and that the sensors are properly connected.

After completing the surface test of the equipment which determines proper functioning and the absence of any prior data from the system, the tool is positioned in the well bore. The clock is programed by the program instruction (a recording delay) to not operate for a sufficient period of time to permit location of the tool in the desired location in the well after the surface test.

Once the tool is located in the well bore at the desired depth, the clock next initiates operation of the CPU and the software program in the CPU (shown in FIG. 2) which locates the first recording program instruction of the recording program instructions.

When the first recording program instruction is located, the software program checks if the recording instruction is complete, i.e. has the entire instruction been implemented. If the first recording instruction has been completed, the software determines if the recording instruction read is the last recording instruction of the instruction program. When the last instruction is reached, the system power is disabled. Prior to reaching the last instruction the recording program finds the first or next recording program instruction. For the first instruction the program sets a data pointer beginning at the start of the data memory. For other recording program instructions, the software program reads the base address of the last instruction and determines the number of samples from the prior instruction reading and takes the next available data memory in the nonvolatile memory to collect the next temperature and pressure data. The collected data is processed in the RAM 17 and is recorded in a set of cells in a nonvolatile memory 20 a first time and then the data is re-entered in the same order to the same set of cells in the nonvolatile memory. If desired the data can be re-recorded more than twice. The purpose for this is that reinforcement by a second entry of the data into the nonvolatile memory insures that the nonvolatile memory adequately records the data. This is necessary because EEPROMS are reliable at ambient temperatures but at the high temperatures in a well bore the temperature limits are close to being reached. Thus, the reinforcement permits successful operation of EEPROMS at higher temperatures. After recording the sampled data, the program determines if the data collected was the last sample of the last instruction to collect data. Prior to the last instruction, the program sets the clock for the next "turn on" period and turns off the power. If the last sample of data instruction has been received or collected, the program determines if the last instruction has been completed, which turns the power off to the CPU. If the last data instruction has not been processed, the clock is set for the next operation and the power is turned off.

In the operation of the foregoing system, the software starts each time the clock turns the power on with the first programed instruction. The programed instructions functions are a series of bytes with information in a fixed array, and one of the bytes is allocated as a marker to indicate whether an instruction is finished or not. When an instruction is finished, the marker byte is used to indicate that an instruction is complete. The program instructions can, for example, consist of 10 bytes each having 8 bits. One byte is left erased as a marker or flag and two bytes are left erased as a place to store an address which is the start data address for the next instruction. The rest of the bytes contain information as to what the instruction is supposed to do.

The number of program instructions available can be 32 but not all of the program instructions need to be used. When the last instruction is completed, the equipment is disabled. Prior to reaching the last instruction the program finds the next recording instruction and determines if the instruction is complete. The program searches the memory, upon completion of an instruction, for the next available memory.

In the nonvolatile memory, it was found that EEPROMS did not reliably obtain a record of the data with a single recording at high temperatures. This is because EEPROMS are not identically responsive to input voltage levels so that data may not necessarily be impressed on the EEPROM sufficiently to provide a read-out of the data. By re-recording the data at least once on the EEPROM, the additive effect insures that the data is applied to the EEPROM for a read-out. Information concerning EEPROMS may be found in the "Electronics" Journal for June 30, 1982 as "5 volt-only EE-PROM mimics static-RAM timing" and in the "EDN" Journal for May 12, 1983 as "understand your application in chosing NOVRAM, EE-PROM".

By using nonvolatile memory, the entire processor can be turned off between sampling periods so that downhole power of the batteries is conserved and the test can be run for a longer period of time.

Referring now to FIG. 3, the system for inputting and collecting data from the memories in the processing equipment is schematically illustrated. As shown in FIG. 3, the tool CPU 18 is normally powered by a battery voltage received on line 28 via a blocking diode to a voltage regulator 33 which supplies a regulated voltage to the CPU 18.

To input or output data to the system, the sensor housing 12 is disconnected to provide access to the connector 30. A data communication or interface circuit 31 is interconnected between the input/output circuit 21 and the CPU 18. The data communication circuit 31 has a first voltage regulator 33 which applies constant operating voltage to the CPU 18 and as necessary to the other circuits. The constant voltage regulator 33 is supplied voltage via the connector 30 from an externally located voltage regulator 35. The voltage regulator 35 is supplied from a source of voltage $V_R$ from a host CPU 37. Thus, the CPU 37 provides an operating voltage independent of the battery source. To place the tool CPU 18 in communication with the host CPU 37, a voltage discriminator circuit 40 is coupled to I/O circuit 21. The external voltage regulator 35 includes a switch means 41 which interconnects a voltage $V_{R1}$ or $VR_1$ to the voltage regulator 35.

The switch means 41 is operated by the host CPU 37 to encode a binary voltage input code to the voltage regulator 35 which is detected by the voltage discriminator 40 in the tool. The voltages $V_{R1}$ and $V_{R2}$ are at a higher level than the battery voltage $V_R$ which functions to place the CPU 18 in a mode to receive or send date from the CPU 18 to the CPU 37. The battery voltage 28 is not necessary for the operation.

The binary voltage input code which is input by voltage pulses representing digital 0 and 1 by programs input into the CPU 37 and the program memory, the software instruction programs and the operating program are input to the tool CPU 18. Thus, the programs are placed in the tool in a non-volatile memory which will retain the programs independent of power to the CPU 18.

During the inputting of the programs, or at the completion of the input of the software, the host CPU 37 executes a verify step which directs the CPU 18 to play back the input programs to the host CPU 37. This is accomplished by encoding the programs as a binary current code. The binary current code is obtained by a transistor circuit 42 in which the current is varied to provide the pulse code from the I/O circuit 21. Externally of the tool, a load resistor 44 detects the current changes (which are in binary code) and inputs the current code to the host computer 37 for a read-out of the program or verification of the data.

The voltage code input is, of course, operated independently of the current code output. This is accomplished by a circuit 46 which separate voltage and current signals. The system thus provides a single communication path for inputting data by a voltage code and outputting data by a current code.

After inputting the program instructions and operating instructions, the tool is ready for the surface test and subsequent collection of data downhole. After collecting the data, at the surface, the tool is again connected to the host CPU 37, where the current code is used to output the collected data to the host CPU 37 for recording and analysis.

It will be apparent to those skilled in the art that various changes may be made in the invention without departing from the spirit and scope thereof and therefore the invention is not limited by that which is enclosed in the drawings and specifications but only as indicated in the appended claims.

We claim:

1. A method of obtaining and storing data in a battery operated well tool having pressure and temperature transducers for sensing pressure and temperature in a well bore where the well tool includes a battery power source, microprocessor means, a random access memory, a non-volatile program memory containing a software program for issuing program instructions, a non-volatile data memory, clock means and pressure and temperature sensor means for developing data samples representation of pressure and temperature, the method including the steps of:

periodically applying electrical power from the power source under the control of the clock means for periodically supplying electrical power as necessary for each of said random access memory, said program memory, said data memory, said microprocessor means, and said pressure and temperature sensor means where each of such periodical applications applies electrical pwoer for a defined period of time;

during each defined period of time, applying program instructions in the program memory to said microprocessor means for finding sample data previously recorded in the data memory, for collecting sample data from said temperature and pressure sensor means, and then for recording the collected sample data from the pressure and temperature means in the data memory separate form sample data previsouly recorded.

2. The method as set forth in claim 1 wherein the data memory includes data banks, and during each defined period of time, said collected sample data is first recorded in a given sequence to a given non-volatile memory bank in the data memory and including the further step of re-recording the same collected sample data in the same given sequence a second time to the given non-volatile memory bank in the data memory and wherein each given non-volatile memory bank is different for each defined period of time.

3. A method of obtaining and storing data in a well tool having a pressure and temperature transducer for sensing pressure and temperature in a well bore when the well tool includes a power source, microprocessor means, a random access memory, a program memory containing a software program for issuing program instructions, a non-volatile data memory having data banks, pressure and temperature transducers for developing sample data representative of pressure and temperature, the method including the steps of:

repetitively sampling said pressure and temperature transducers for obtaining sample data in a first data sequence for recording in a non-volatile data memory for each repetitive sampling of a pressure or temperature transducer and where each samping occurs for a defined period of time during each sampling;

for each defined period of time, applying program instructions in the software program to said microprocessor means for finding the last recorded data sample in a data bank in the data memory and for recording data obtained during a defined period of time in a first sequence in a different memory bank of the data memory, and then for rerecording the sample sample data obtained during the defined period of time in said first sequence over the recorded sample data in the memory bank for applying the same sample data to the same memory bank at least two times.

4. The method as set forth in claim 3 wherein the well tool has a battery operated power source and the program memory is a non-volatile memory and further including the step of periodically applying power from the battery power source to said microprocessor, said random access memory means, said program memory, said data memory and said transducers for said defined period of time and where the software program and each sample data is retained, respectively, in the non-volatile program memory and in the data memory during the intervals between the defined periods of time when the power source is not applied to said microprocessor, said random access memory means, said program memory, said data memory and said transducers.

5. A self contained system in a housing for collecting and storing pressure and temperature data in a well bore where said housing is adapted for passage through a well bore, said system including, temperature sensor means for developing sample data representative of temperature in a well bore;

pressure sensor means for developing sample data representative of pressure in a well bore;

a power source, microprocessor means for collecting and for processing sample data from said pressure and temperature sensor means, memory means including a non-volatile program memory for storing software program instructions, and data memory means having memory banks for recording and storing sample data in such memory banks, said pressure and temperature sensor means being coupled for data transmission to said microprocessor means to said data memory means; and means for periodically initiating said software program instructions in said program memory means during a defined period of time for operating said microprocessor means and said program memory means, said program instructions accessing said data memory means to said sensor means for collecting sample data in a first sequence from the sensor means during the defined period of time and for applying said sample data in a first sequence to a memory bank in the memory means and reapplying the said sample data in the same first sequence to the same memory bank at least one more time.

6. The apparatus as defined in claim 5 wherein the well tool has a battery operated power source and the program memory in a non-volatile memory and wherein the means for periodically initiating said software instructions includes a clock coupled between said battery operated power source and each of said microprocessor, said random access memory means, said program memory, said data memory and said transducers for applying power for said defined period of time and where the software program and each sample data is retained, respectively, in the non-volatile program memory and in the data memory during the intervals between the defined periods of time when the power source is not applied to said microprocessor, said random access memory means, said program memory, said data memory and said transducers.

7. A self contained system in a housing for collecting and storing pressure and temperature data in a well bore where said housing is adapted for passage through a well bore, said system including temperature sensor means for developing sample data representative of temperature in a well bore;

pressure sensor means for developing sample data representative of pressure in a well bore;

a battery operted power source, microprocessor means for collecting and for processing data from said pressure and temperature sensor means, memory means including a programmable read-only non-volatile program memory means for storing program instructions, and non-volatile data memory means having memory banks for recording and storing sample data in such memory banks, said pressure and temperature sensor means being coupled for data transmission to said microprocessor means and to said data memory means;

means for periodically applying power from said power source to said microprocessor means, said memory means and said sensor means for a defined period of time for collecting and for storing sample data in said non-volatile data memory means independently of the power source; and means for controlling the microprocessor means during said defined period of time for applying said program instructions during the period of time to said data memory means, and said pressure and temperature sensor means for accessing the data memory means for collecting sample data from the sensor means during each such period of time and for applying said collected sample data during each such period of time to a separate memory bank in the non-volatile data memory means.

8. The apparatus as defined in claim 7 wherein the program instructons, during each defined period of time, operate for first recording said collected sample data in a given sequence to a given non-volatile memory bank in the data memory and secondly re-record the same sample collected data in the same given sequence a second time to the given non-volatile memory bank in the data memory.

* * * * *